US006279427B1

(12) United States Patent
Francis

(10) Patent No.: US 6,279,427 B1
(45) Date of Patent: Aug. 28, 2001

(54) CROSSHEAD JAM NUT TORQUE TOOL

(75) Inventor: Dale Francis, Gretna, LA (US)

(73) Assignee: Francis Torq/Lite, Inc., LA (US)

( * ) Notice: Subject to any disclaimer, the term of this patent is extended or adjusted under 35 U.S.C. 154(b) by 0 days.

(21) Appl. No.: 09/444,274

(22) Filed: Nov. 19, 1999

Related U.S. Application Data

(60) Provisional application No. 60/134,824, filed on May 19, 1999.

(51) Int. Cl.[7] ..... B25B 13/46
(52) U.S. Cl. ..... 81/57.39; 81/58
(58) Field of Search ..... 81/57.39, 59.1, 81/58.2, 58

(56) References Cited

U.S. PATENT DOCUMENTS 1,871,857 * 8/1932 Martois ..... 81/57.16
2,758,493 * 8/1956 Goldwater ..... 81/58.2
4,309,923 * 1/1982 Wilmeth ..... 81/57.34
4,669,338 * 6/1987 Collins ..... 81/57.39
4,916,986 * 4/1990 Junkers ..... 81/57.39
5,097,730 * 3/1992 Bernard et al. ..... 81/57.39
5,277,087 * 1/1994 Wilson, Jr. et al. ..... 81/57.29
5,381,709 * 1/1995 Louw ..... 81/59.1

* cited by examiner

*Primary Examiner*—Derris H. Banks
*Assistant Examiner*—David B. Thomas
(74) *Attorney, Agent, or Firm*—Garvey, Smith, Nehrbass & Doody, LLC

(57) ABSTRACT

A uniquely designed torque wrench having a torque body, the torque body attached to a drive head, with the head having an opening through its center, for fitting over a nut, such as a multi-sided jam nut positioned on a compresor shaft. The drive head further provides a portion which can be disengaged and opened, to define a gate which can allow the jam nut to be positioned within the opening, and the gate portion resecured, to define the head secured around the jam nut. There is further provided a hydraulic cylinder secured between the wrench body and the head so that under hydraulic pressure, the head is rotated which in turn imparts sufficient rotation to the jam nut under sufficient pressure to torque up the nut to the desired foot pounds required. Another embodiment includes an adaptor insertable into the opening of the torque wrench for accommodating a certain jam nut configuration, so that the tool can be used on the varied types of jam nut designs.

10 Claims, 5 Drawing Sheets

FIG. 6
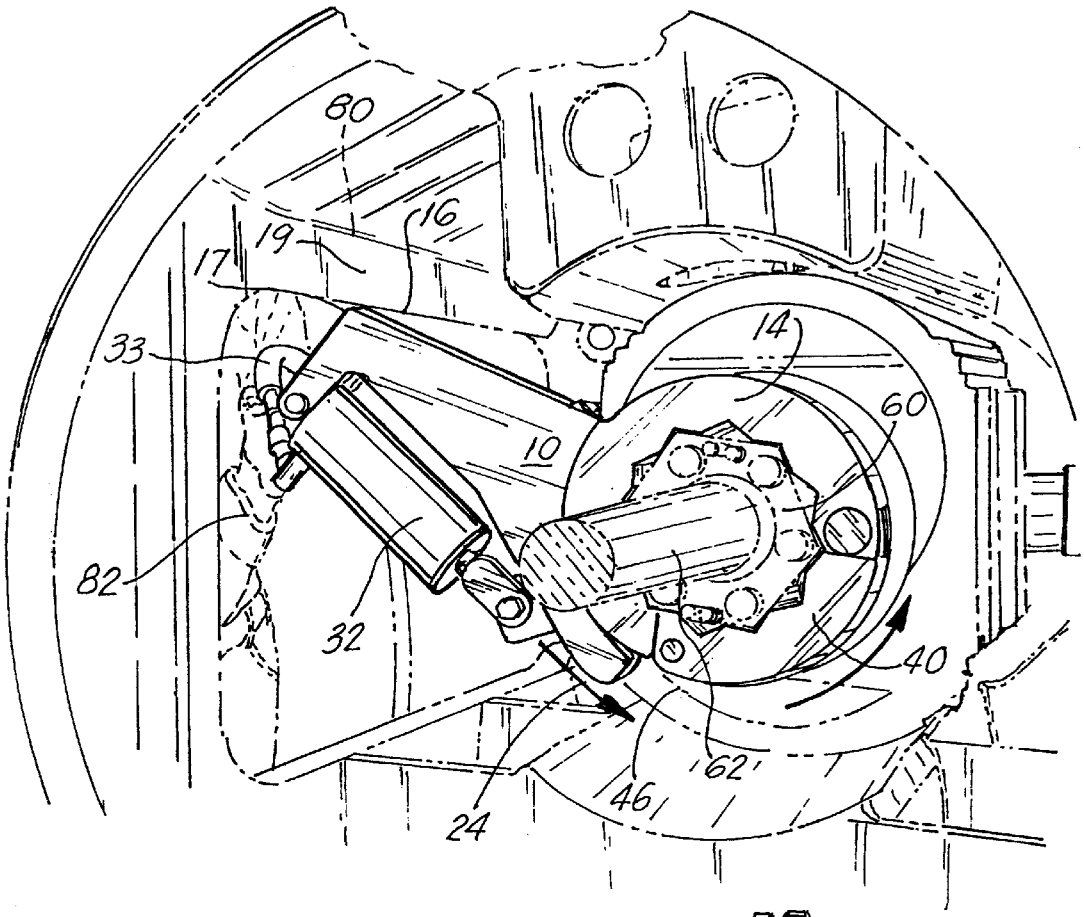
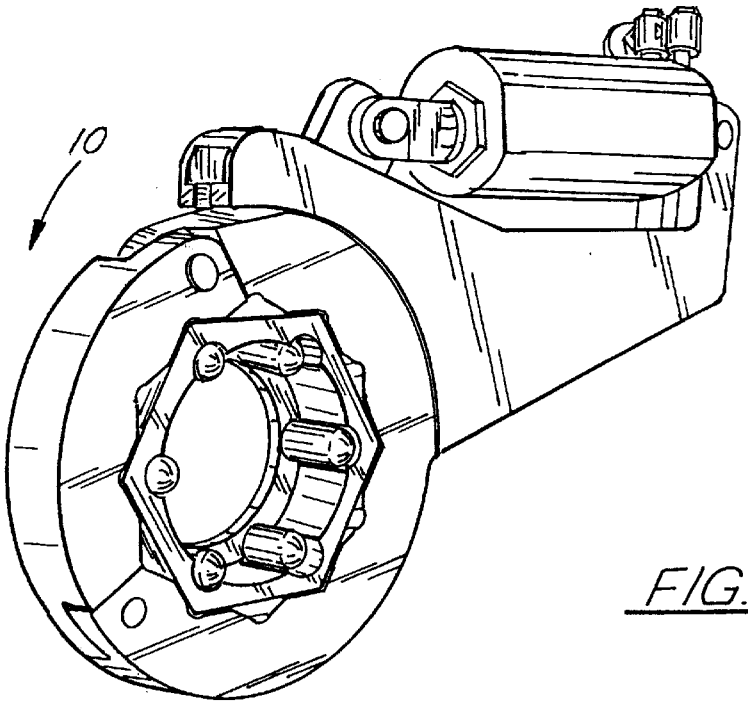
FIG. 9

CROSSHEAD JAM NUT TORQUE TOOL

CROSS-REFERENCE TO RELATED APPLICATIONS

Priority of U.S. Provisional Patent Application Ser. No. 60/134,824, filed May 19, 1999, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to torque tools. More particularly, the present invention relates to a uniquely designed hydraulic torque wrench for tightening and loosening a compressor jam nut of the type for securing a compressor shaft which would prevent access to the jam nut with a closed end wrench.

2. General Background of the Invention

Throughout industry, compressors are used for supplying air or other fluid under pressure to operate industrial machinery. The type of compressor particular to this invention is the type which is driven by an engine, such as an internal combustion engine. The engine operates the compressor through the use of a compressor shaft extending from the engine to the compressor for driving the compressor. In such an arrangement, the compressor shaft is secured in place with the use of a threaded member referred to as a compressor jam nut. The jam nut, well known in industrial applications, has the compressor shaft running through it, so that the nut may be torqued up to a certain foot pounds to secure the nut in place.

One of the problems confronted in this arrangement, the fact the compressor shaft is connected on both ends, one end to the engine, and the second end to the compressor, so that access to the nut, in order to torque it to the desired torque, is severely limited. For example, because the nut is not easily accessible, and because the shaft running through it precludes the nut from accommodating a "ratchet" type wrench, an opened wrench, commonly known as a crescent wrench, must be utilized. However, the necessary amount of torque, which at times may be at least 14,000 ft.-lbs., cannot be applied through the strength of a person. Therefore, when an open-ended wrench is used, in the present state of the art, requires that one person hold the wrench in place upon the jam nut, and a second man strike the wrench handle with a sledge hammer a certain number of times. At the present, it is suggested, that to reach a torque of approximately 14,000 ft.-lbs., the wrench must be struck 78 times with a 16-lb. sledge hammer. One can readily see this method of torquing up a jam nut as being quite archaic, if not approaching barbaric in its application.

One possible solution to the problem of supplying sufficient torque would be through the use of a hydraulic torque wrench, for example of the type as seen in U.S. Pat. No. 5,097,730, incorporated hereinto by reference. In the use of torque wrenches, most torque wrenches are closed in the sense that the wrench's working end fits over the head of a bolt or a nut for access to the multi-sided piece in order to loosen it or tighten it. However, as stated earlier, a compressor jam nut is positioned along the body of a compressor shaft which is secured on both its ends, and has to be loosened or tightened. However, since a regular torque wrench is closed end, a conventional torque wrench, as is currently known in the art, cannot slip over the jam nut because of the compressor shaft running through it. Therefore, there is a need in the industry for a new type of a wrench which can be opened and would allow the tool to be placed around the nut for loosening or tightening the nut which the nut is secured to the compressor shaft.

BRIEF SUMMARY OF THE INVENTION

The apparatus of the present invention solves the problems in a simple and straight forward manner. What is provided is a uniquely designed torque wrench having a torque body, the torque body attached to a drive ratchet head, with the head having an opening through its center, for fitting over a nut, such as a multi-sided jam nut. The drive ratchet head further provides a portion which can be disengaged and opened, to define a gate which can allow the jam nut to be positioned within the opening, and the gate portion resecured, to define the head secured around the jam nut. There is further provided a hydraulic cylinder secured between the wrench body and the head so that under hydraulic pressure, the head is rotated which in turn imparts sufficient rotation to the jam nut under sufficient pressure to torque up the nut to the desired foot pounds required. Another embodiment includes an adaptor insertable into the opening of the torque wrench head for accommodating a certain jam nut configuration, so that the tool can be used on the varied types of jam nut designs.

Therefore, it is a principal object of the present invention to provide a unique "split head" design which allows the wrench to be placed over a nut having a shaft extending therethrough, through the use of a gated portion of the head;

It is a further object of the present invention to provide a unique split head design for a torque wrench which allows the wrench to be placed on a jam nut secured around a compressor shaft so that sufficient torque can be placed on the jam nut through the use of hydraulic pressure eliminating manual torquing up of the nut;

It is a further object of the present invention to provide the unique "split head" design placed around a piston rod and on a jam nut in a short amount of time which provides for accurate tightening or loosening of the jam nut in a short amount of time;

It is a further object of the present invention to provide an improved hydraulic wrench designed to be secured around cross head jam nuts for providing an accurate torquing of the jam nut to 30,000 ft. lbs. with the use of standard bi-directional 10,000 psi hydraulic pump;

It is a further object of the present invention to provide an improved hydraulic jam nut wrench which can be secured with an adaptor for allowing varied designs of jam nuts to be torqued up or loosened with the improved wrench system.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 6 is a side view of the torque wrench of the present invention mounted on a jam nut of a compressor shaft extending from an internal combustion engine;

FIG. 9 illustrates the torque wrench housing the adaptor secured around the jam nut of the type illustrated in FIG. 8.

DETAILED DESCRIPTION OF THE INVENTION

Figure 1:
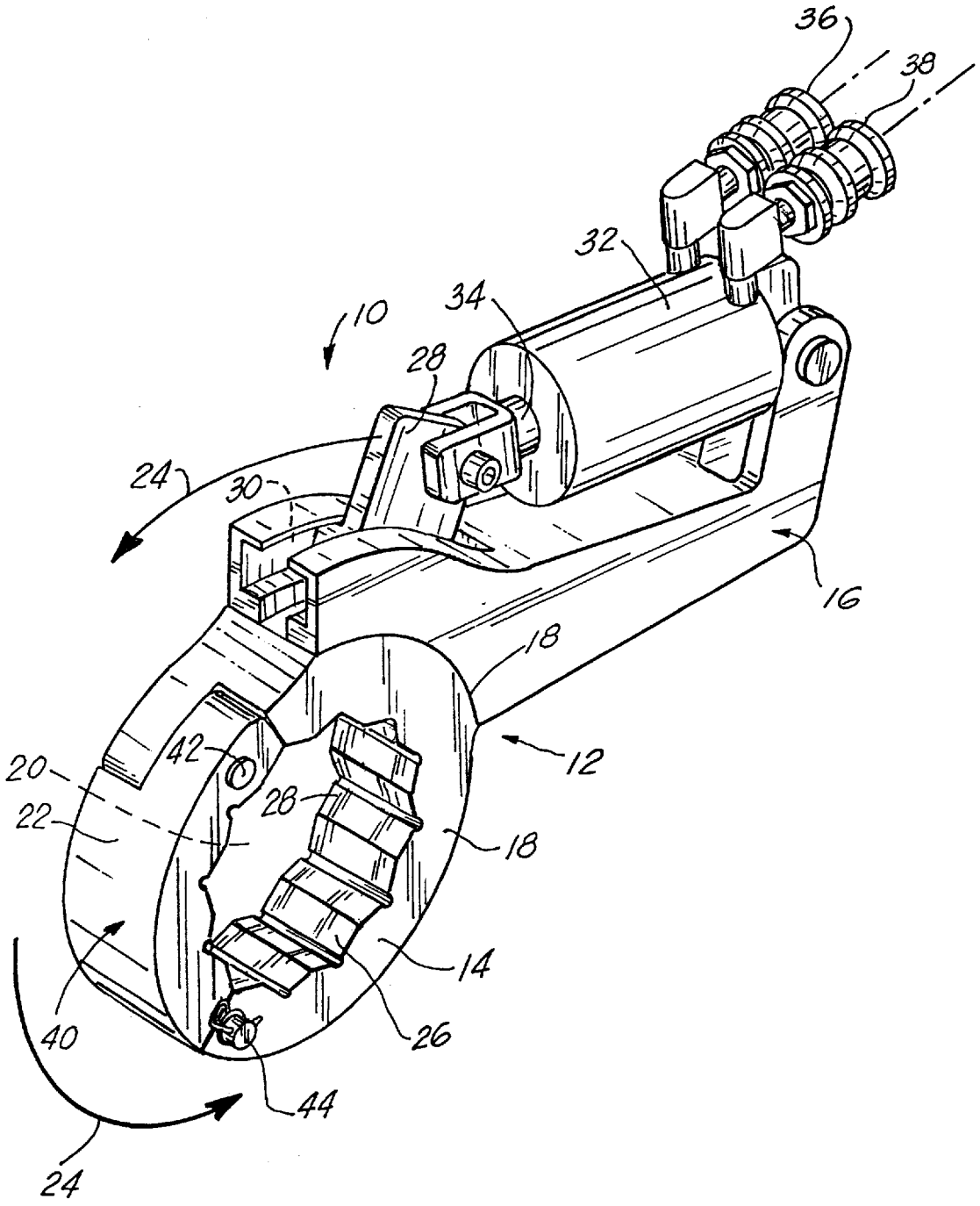
FIG. 1 is an overall perspective view of the new torque wrench of the present invention.

FIGS. 1–9 illustrate the preferred embodiment of the apparatus of the present invention by the numeral 10. As illustrated clearly in FIG. 1, improved torque wrench 10 of the type of torque wrench commonly known in the art for loosening or tightening nuts or bolts to a certain degree of torque, and of the type as illustrated and disclosed in U.S. Pat. No. 5,097,730 entitled "Inline Ratcheting Tool", incorporated herein by reference. As illustrated, improved torque wrench 10 would include a wrench body 12 having a substantially circular head portion 14 on a first end and a rear body portion 16 on its second end. Noting head portion 14, portion 14 would include a substantially circular wall portion 18 having an opening 20 therethrough for securing a nut, such as a jam nut therein. The outer surface 22 of head portion 14 would be substantially smooth and would be rotatable in the direction, for example, of arrows 24 as seen in FIG. 1. The interior surface 26 of opening 20 would be designed to accommodate a nut having a hexagon or octagon configuration, so that the various wall portions 28 would engage around the nut so as to rotate the nut when the head portion 14 is rotated. As further illustrated, head portion 14 would include an arm member 28 extending from its upper surface which would travel through a track 30 as the head member is rotated as was discussed earlier. Reference is now made to the second portion 16 of body 12 which is a portion for accommodating a means for moving the head portion 14 or for rotating portion 14 in the use of the wrench. As is illustrated, there is seen a hydraulic cylinder 32 which houses a piston internally on a rod 34 with the hydraulic cylinder being fed with a pair of hydraulic lines 36, 38 so that as hydraulic fluid is pumped into cylinder 32 via one hydraulic line (36, for example), the piston is moved out from the cylinder 32 and the arm 28 is moved in the direction of arrow 24 thus imparting rotation to head member 14. Next, the arm member can be rotated to the current position as seen in FIG. 1, as the hydraulic fluid is withdrawn from cylinder 32 during operation.

One of the features which is noted, for example in FIG. 1, is that head 14 does not incorporate a continuous circular head portion but there is illustrated a "split head" or gate portion 40 which extends from a first hinged end 42 to a second pin end 44, the function of which will be described further.

Figure 2:
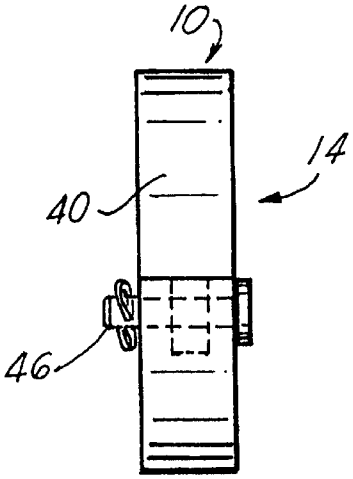
FIG. 2 illustrates a front view of the new torque wrench with the gate member in the closed position.
Figure 3:
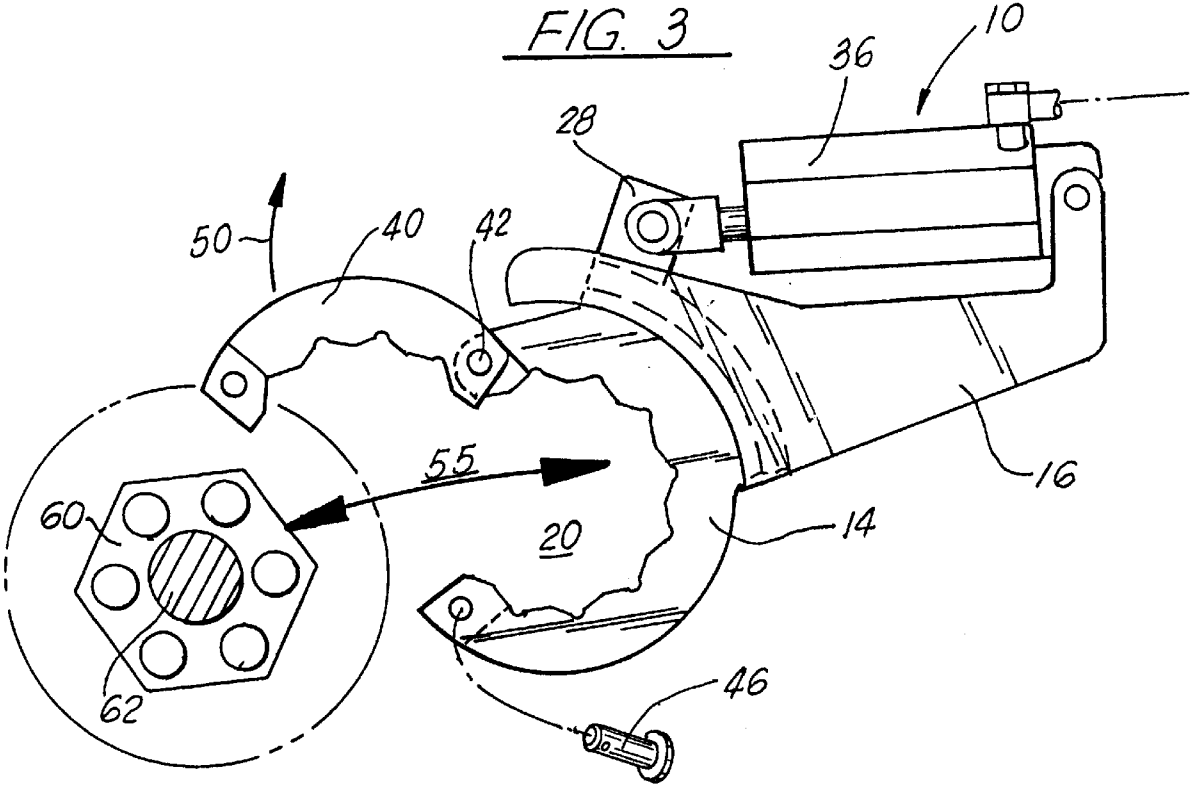
FIG. 3 illustrates a side view of the new torque wrench of the present invention with the gate portion in the open position and being secured around a jam nut.

Turning now to FIGS. 2 and 3, first in FIG. 2, there is seen an end view of the head portion 14 of wrench 10 which again shows the gated or split head portion 40 secured in place via a coder pin 46 and held in place. Turning now to FIG. 3, again there is a clear example of the improved torque wrench 10 which illustrates the split head portion 14, the rear portion 16 and the hydraulic cylinder 32 secured to the upper arm 28 of head portion ready for use. However, in this particular view, the split head or gated portion 40 has been moved to the open position in the direction of arrow 50 by removing the coder pin 46 and allowing the gate 40 to swing open along hinge line 42. This is a critical aspect of the invention in view of the fact that as further illustrated in FIG. 3, there is seen what is termed a jam nut 60 which is a nut secured around a compressor shaft 62, so that the shaft 62 which is extending out from the jam nut and secured on its end, would not allow a closed end wrench to be accommodated thereupon. Therefore, in the position as seen in FIG. 3, the gate portion 40 has been opened a sufficient width 55 which allows the jam nut to be moved into the opening 20 of the head portion and once in place, the gate 40 would then be closed around the jam nut 60.

Figure 5:
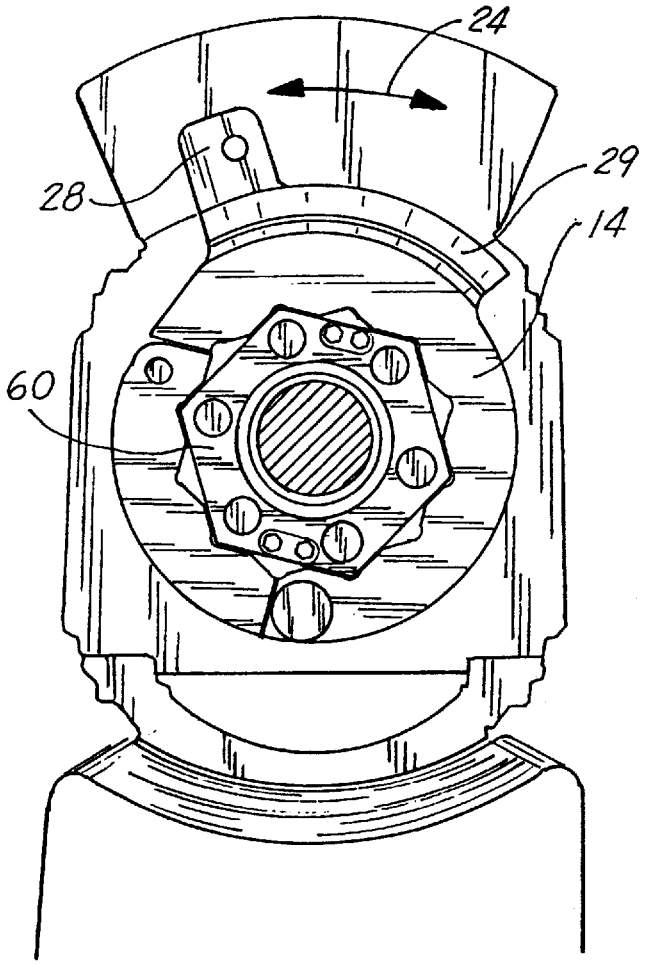
FIG. 5 is a cutaway of the head of the torque wrench body of the present invention secured around a typical jam nut mounted on a compressor shaft.
Figure 4:
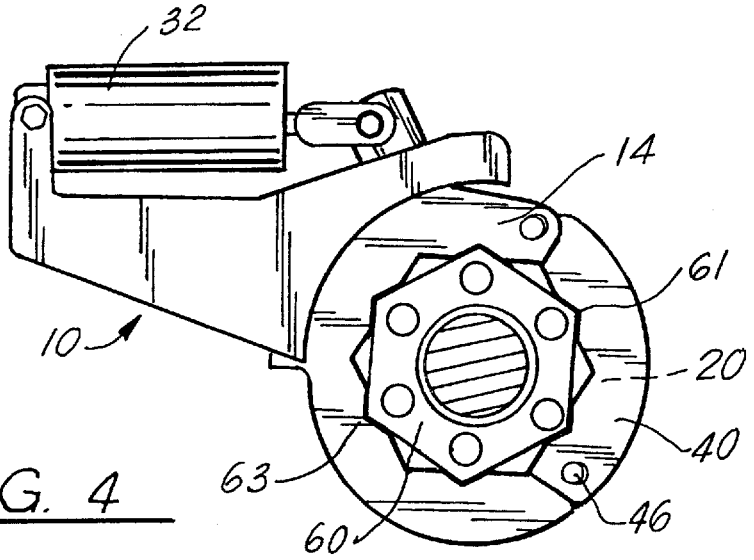
FIG. 4 is a side view of the torque wrench mounted on the jam nut.

Reference is now made to FIGS. 4 and 5, where there is illustrated, for example in FIG. 4, the wrench 10 with the head portion 14 secured around jam nut 60 with each of the hexagonal points 61 of the nuts 60 secured within a hexagonal opening 63 of the opening 20 in head 14 which fixes the nut securely within head 14 for rotation of the nut either to tighten the nut or loosen the nut through the use of the hydraulic cylinder 32 as was explained earlier. It should be noted that again as seen in FIG. 4 when the nut is secured by the head 14 that the gated portion 40 is again locked in place via coder pin 46 and the gated portion 40 while in the closed position serves as a continuation of the substantially circular head 14. FIG. 5 illustrates substantially the same view as FIG. 4 but for the fact that there is a cut away view showing how the head portion 14 is secured around nut 60, with the arm member 28 extending from the raised portion 29 of head 14 which travels within the channel 30 as was seen in FIG. 1, while the head is being rotated in the direction of arrow 24.

As seen in FIG. 5, there is illustrated clearly the jam nut 60 which is mounted onto the compressor shaft 62 with the compressor shaft 62 being shown within a chamber 80 which extends between the engine portion (not illustrated), and outward to the compressor at the other end of the shaft 62. In this particular view, there is illustrated a person 82 which has placed the torque wrench 10 around the nut 60 as was described earlier, opening gated portion 40, and closing it around the jam nut 60 and securing it in place with pin 46. When hydraulic fluid is pumped into cylinder 32 via line 33, the head 14 of the wrench will begin to rotate in the direction of arrow 24 and with the jam nut 60 being in this case, perhaps, loosened from its torque. When that is done, the end portion 16 of the wrench will have a reaction point 17 which will make contact with a surface 19 which will allow it to be held fast in place while the head 14 is rotated and the nut 60 is either torqued up or torqued down. In this instance, for example, since the nut is being rotated in the counter clockwise direction as seen by arrows 24, the nut 60 is being loosened. Once a slight turn has been made on the nut which will "crack it loose", the nut can then be manually loosened. When the nut must be tightened, the gated portion 40 would be opened, the wrench 10 would be removed and turned 180 degrees and resecured around the nut so that when the cylinder 32 was expanded one more the nut 60 would be turned in the clockwise direction to tighten it. In operation, again, the nut would be manually tightened until it could be tightened no further, the wrench would be placed around the nut and the nut then would be rotated until the piston rod had completely extended from the cylinder. Once that is achieved, the wrench would then be removed from the nut, the rod would be retracted back into the cylinder 32 and the wrench 10 would be placed back onto the nut 60 so that an additional rotation of the nut 60 could take place. This may occur a few times until the nut has been torqued to the desired torque as was explained earlier.

Figures 7, 8:
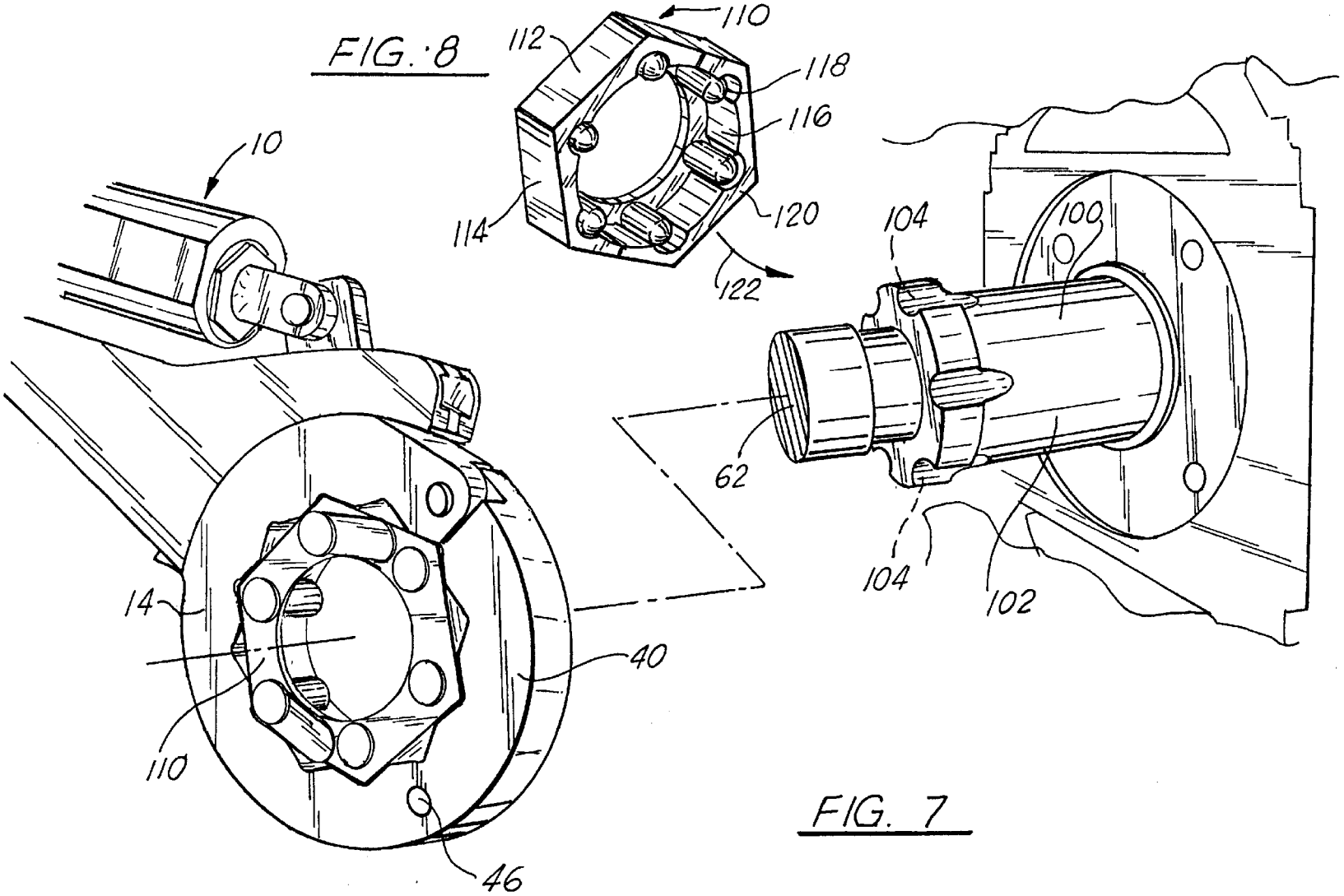
FIG. 7 illustrates a jam nut mounted on a compressor shaft with the adaptor as illustrated in FIG. 8 mounted onto the torque wrench to be secured around the jam nut.
FIG. 8 illustrates a view of the adaptor to be utilized on the torque wrench to accommodate a certain design of jam nut.

Reference is now made to FIGS. 7–9 which illustrate the torque wrench 10 having the identical type of features as was described earlier, except in this particular embodiment, the wrench is being used on the type of jam nut which has a particular configuration other than the hexagonal or octagonal configuration as do most jam nuts. As seen in FIG. 7, the jam nut in question is illustrated by the numeral 100 which includes a substantially circular body portion 102 but includes a plurality of indentures 104 around its surface which serves as the surface for rotating the nut which has been secured around shaft 62. Because this particular type of jam nut 100 is not hexagonal or octagonally shaped, there is needed an adaptor in order to operate this nut. Reference then is made to FIG. 8 whereas there is illustrated an adaptor 110 which includes a body portion 112 having a plurality of hexagonal sides 114 which would be accommodated in the improved hydraulic wrench 10 at the type illustrated in FIG. 9. The only difference is that the adaptor 110 includes an interior surface 116 which includes a plurality of members 118 which have an outer surface which is accommodated onto the indentured surface 104 of the jam nut. Like the head 14 of the wrench 10, the adaptor must also include a gated portion 120 which may open in the direction of arrow 122 and the adaptor would be placed around the jam nut 100 and then closed around the nut. At that point the wrench 10 would then be opened to fit around the hexagonal walls 112 of the adaptor and then adaptor 110 would then be secured within the head 14 of wrench 10 as illustrated in FIG. 8. Once that is complete and the gated portion 40 is locked in place around adaptor 110, then the wrench can undergo the conventional operation of rotating the head 14 in order to tighten or loosen the jam nut 100 as illustrated in the figures. As noted earlier, FIG. 9 illustrates a side view of torque wrench 10 with the adaptor 110 secured within the head opening 120.

It should be made clear that because of the manner in which the "split head" 14 of the improved wrench 10 operates, even though one would forget to place the pin 46 back into the head 14 so as to assure that gate 40 is closed, it has been found that when force is placed upon the head to rotate and tighten the jam nut 60, the gate 40 is automatically pressed tightly against the remaining portion of head 14 and in effect, is self-closing. Although it is best that the pin 46 be placed within the opening so as to make certain that the head 14 maintains in the closed position while there is force being placed on the nut 60.

The foregoing embodiments are presented by way of example only; the scope of present invention is to be limited only by the following claims.

What is claimed is:

1. An improved torque wrench system, comprising:

a) a torque wrench body;

b) a drive head mounted on a first end of the torque wrench body;

c) a hydraulically powered cylinder mounted on the torque body and inter-connected between the torque body and the drive head for driving the drive head during loosening or tightening of the jam nut;

d) a gated portion, defining less than 50% of the drive head, for moving between closed and open positions, so that in the open position, the head may be placed around a nut, and in the closed position, the gated portion defines a portion of the head which will be driven to rotate the nut to achieve desired torque.

2. The torque wrench system in claim 1, wherein the gated portion moves between open and closed position via a hinged end.

3. The torque wrench system in claim 1, wherein the gated portion is held in the closed position by a cotter pin securing to the rest of the head portion.

4. The torque wrench system in claim 1, further comprising a reaction pad on the second end of the torque wrench body for allowing stroke out when applying torque to the jam nut once the cylinder is fully extended.

5. An improved torque wrench for loosening or tightening jam nuts mounted on a compressor shaft, comprising:

a) a torque wrench body;

b) a moveable drive head mounted on a first end of the torque wrench body;

c) a hydraulically powered cylinder mounted on the torque body and inter-connected between the torque body and the movable head for driving the drive head during loosening or tightening of the jam nut;

d) a portion defining less than 50% of the drive head disengageable from the drive head for allowing the drive head to be engaged around the jam nut while the nut is mounted on the compressor shaft, and the disengageable portion reengaged onto the drive head for fully engaging around the jam nut during the loosening and tightening.

6. The improved wrench in claim 5, further comprising a reaction pad on the second end of the torque wrench body for allowing stroke out when applying torque to the jam nut once the cylinder is fully extended.

7. The improved wrench in claim 5, further comprising an adaptor positionable within the opening of the drive head, for securing around a jam nut of a certain design.

8. The improved wrench in claim 5, wherein the disengageable portion comprises a gate member formed along the head, hinged on a first end for swinging between open and closed positions, and secured closed on a second end when the jam nut has been positioned within the opening of the head for rotation.

9. The improved wrench in claim 5, wherein the jam nut may be torqued up to 30,000 ft.-lbs. by the wrench while the jam nut is secured around the compressor shaft.

10. An improved torque wrench for loosening or tightening jam nuts mounted on a compressor shaft, comprising:

a) a torque wrench body;

b) a moveable substantially circular drive head mounted on a first end of the torque wrench body;

c) a hydraulically powered cylinder mounted on the torque body and inter-connected between the torque body and the movable drive head for driving the drive head during loosening or tightening of the jam nut;

d) a gated portion defining less than 180° of the substantially circular drive head disengageable from the drive head for moving to an open position to allow the drive head to be engaged around the jam nut while the nut is mounted on the compressor shaft, and when returned to a closed position, to be reengaged onto the drive head for fully engaging around the jam nut during the loosening and tightening.

* * * * *